US010222163B2

(12) United States Patent
Couvillion

(10) Patent No.: US 10,222,163 B2
(45) Date of Patent: Mar. 5, 2019

(54) METHOD AND APPARATUS FOR FIREARM SOUND SUPPRESSION

(71) Applicant: Roy J. Couvillion, Lafayette, LA (US)

(72) Inventor: Roy J. Couvillion, Lafayette, LA (US)

( * ) Notice: Subject to any disclaimer, the term of this patent is extended or adjusted under 35 U.S.C. 154(b) by 0 days.

(21) Appl. No.: 15/634,732

(22) Filed: Jun. 27, 2017

(65) Prior Publication Data

US 2017/0307323 A1 Oct. 26, 2017

Related U.S. Application Data

(63) Continuation-in-part of application No. 15/092,377, filed on Apr. 6, 2016.

(51) Int. Cl.
*F41A 21/30* (2006.01)
*F41A 21/34* (2006.01)
*F41A 21/36* (2006.01)

(52) U.S. Cl.
CPC ..... *F41A 21/30* (2013.01); *F41A 21/34* (2013.01); *F41A 21/36* (2013.01)

(58) Field of Classification Search
CPC ..... F41A 21/30; F41A 21/34; F41A 21/36
USPC ..... 89/14.4, 14.2; 181/223
See application file for complete search history.

(56) References Cited

U.S. PATENT DOCUMENTS 1,354,416 A * 9/1920 Oliver ..... F41A 21/30 89/14.4
2,872,848 A * 2/1959 Schuessler ..... F41A 21/36 89/14.3
5,367,940 A * 11/1994 Taylor ..... F41A 21/36 89/14.3
9,500,427 B1 * 11/2016 Larue ..... F41A 21/30

* cited by examiner

*Primary Examiner* — Samir Abdosh
(74) *Attorney, Agent, or Firm* — Ted M. Anthony

(57) ABSTRACT

A sound suppressor assembly for use in providing a means to maximize firearm suppressor efficiency with regards to maximizing sound attenuation while minimizing physical size and weight and minimizing firearm backpressure and manufacturing costs. A sound suppressor assembly comprising a closed inner cylinder that is received within a separate outer cylinder having a substantially larger diameter and substantially longer length than said inner cylinder. A sound suppressor assembly comprising a plurality of apertures, or openings, that are coaxially aligned within the assembly, thus providing a means to attach said sound suppressor assembly to a firearm muzzle at a proximal planar end of the present invention, for a bullet and ejection mass to enter a proximal end of said inner cylinder and for said bullet and ejection mass to exit through a distal end of said sound suppressor assembly of the present invention.

3 Claims, 8 Drawing Sheets

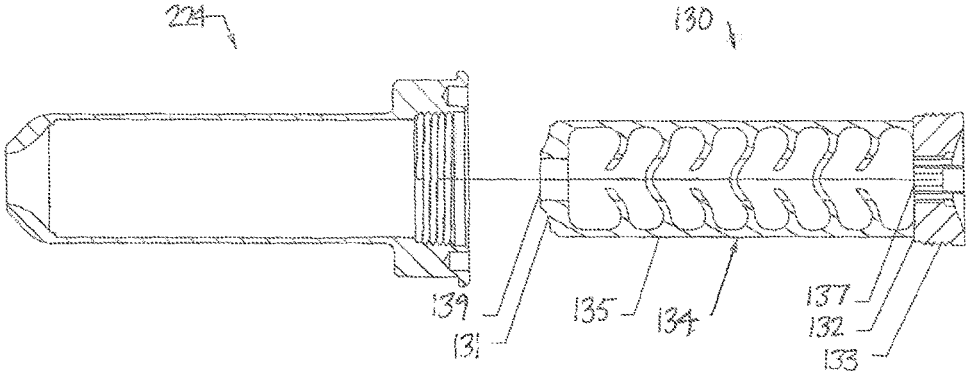
Fig. 4b
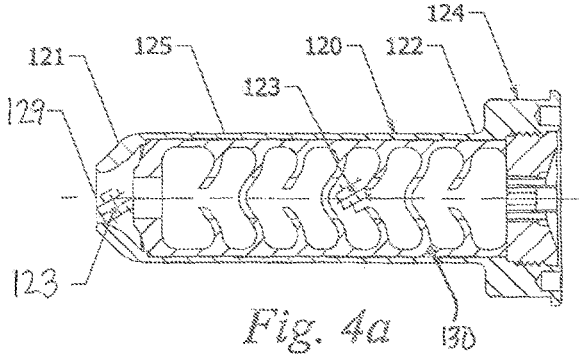
Fig. 4a
Fig. 4

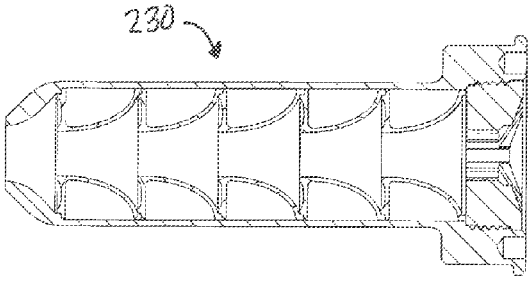
Fig. 5a
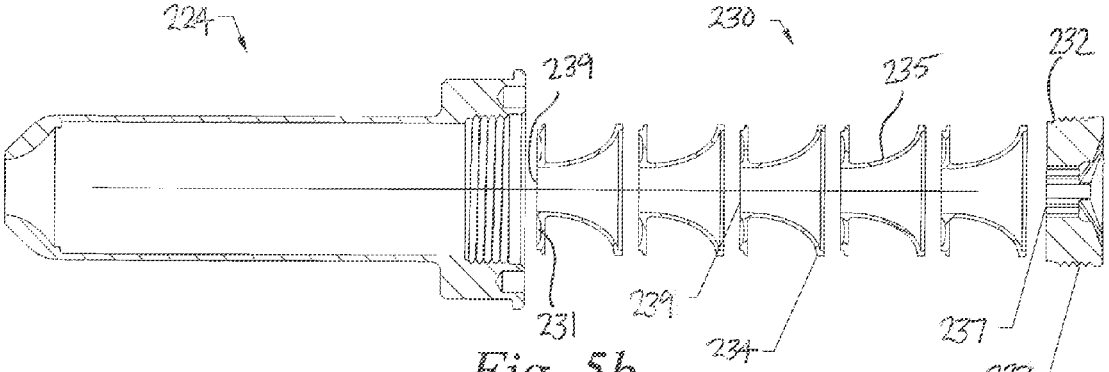
Fig. 5b
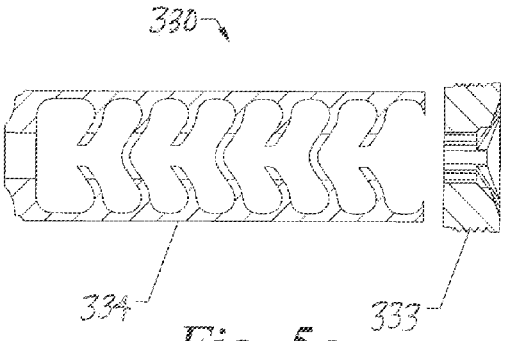
Fig. 5c
Fig. 5

METHOD AND APPARATUS FOR FIREARM SOUND SUPPRESSION

CROSS-REFERENCES TO RELATED APPLICATION

THIS APPLICATION IS A CONTINUATION-IN-PART OF application Ser. No. 15/092,377, FILED Apr. 6, 2016, INCORPORATED HEREIN BY REFERENCE, CURRENTLY PENDING.

STATEMENTS AS TO THE RIGHTS OF THE INVENTION MADE UNDER FEDERALLY SPONSORED RESEARCH AND DEVELOPMENT

NONE

BACKGROUND OF THE PRESENT INVENTION

Field of the Invention

The present invention pertains to a sound suppressor assembly for use in providing a means to maximize firearm suppressor efficiency with regards to maximizing sound attenuation, while minimizing physical size and weight, minimizing firearm backpressure, minimizing firearm recoil, maximizing target sight retention and minimizing manufacturing costs. More particularly, the present invention pertains to a firearm sound suppressor assembly for use in minimizing interference of a bullet, or any other projectile in flight, by a plurality of forces that are generated by said sound suppressor assembly, a firearm, vibrations transmitted through the firearm, firearm propellant, and/or any gases or byproduct of combustion of said firearm propellant. More particularly still, the present invention pertains to a method of firearm sound suppression for use in providing a means to attach said sound suppressor assembly to a firearm muzzle at a proximal end of the present invention, for a projectile and ejection mass to enter a proximal end of an inner cylinder and for said bullet and ejection mass to exit through a distal end of said sound suppressor assembly of the present invention.

Brief Description of the Prior Art

Firearm suppressors, referred to by U.S. federal statutes as "silencers" or "mufflers," are primarily designed to reduce unwanted effects of a muzzle blast and can also be made to improve the performance and accuracy of a weapon and said weapon's shooter. The terms "suppressor", "muffler" and "silencer," as well as their linguistic variants, are synonymous in the context herein.

The most commonly considered purpose of a suppressor is the reduction of the sound pressure level resulting from the explosive release of pressurized gases and burning propellant as a bullet exits a firearm barrel. Such conventional suppressors usually attach to a firearm muzzle at a proximal end of the device and simultaneously contain the explosion and manage the flow of gases and suspended propellant within a series of chambers. The chambers are typically separated by a plurality of baffles that are designed to slow the release of gases and suspend the burning propellant in the gas flow until expelled from the device. The events within each of the separate chambers are substantially similar and progressive in occurrence, beginning with the firearm discharge at the proximal end of the device and then through each successive chamber until the gases and suspended solids exit through a bullet pathway hole at a distal end of the device.

Design efforts for said conventional suppressors typically focus on reductions in sound intensity as, since the transition to baffle-based designs which do not touch the bullet, it has often been assumed that effects of sound suppressors on bullet flight are insignificant. There are anecdotal reports of suppressor effects on accuracy and flight dynamics, as well as untested hypotheses regarding the responsible mechanisms. Transitional ballistics is not well understood in general, but it is believed in most cases (including suppressors), that unequal pressures at different points on the bullet can affect flight dynamics by introducing inaccuracy, yaw, and velocity variations.

Design efforts for conventional suppressors also typically focus on containing and managing the flow and propagation of gases. The treatment of solids, such as unburned and burning propellant, soot and coalescing metal vapor, generally considers methods to keep the solids suspended within the gas for eventual ejection to avoid deposition within the device. Many devices are permanently sealed or otherwise impractical to disassemble making removal of such deposits difficult and, in some cases, impossible. The accumulation of these deposits can adversely affect the performance of the device and can destroy or cause catastrophic failure of the device.

As such, the firearm sound suppressor assembly of the present invention pertains to a device for use in separating solids from the gas flow and managing the gas flow through the device and about the bullet. Propellant particles that are ejected from the firearm muzzle are thereby trapped within the device in order to burn harmlessly or remain unburned. Explosive gases near the bullet are carefully managed to reduce the effect of unbalanced forces on the bullet. The device can be made to be easily disassembled for cleaning, inspection, repair or upgrade. The structures of the device also serve to improve vibration characteristics of the firearm at the muzzle, reduce and/or manage recoil to improve the firearm's positional stability, and even improve bullet/projectile stability.

SUMMARY OF THE PRESENT INVENTION

The present invention pertains to a device for use in muffling noises and reducing visible flash generated by the release of gases and exploding propellant from a firearm muzzle. This is commonly and collectively referred to as firearm "blast suppression," and the devices used to accomplish this are commonly referred to as "silencers" or "suppressors."

In a preferred embodiment, the device of the present invention comprises a closed outer container, or cylinder, having a proximal end and a distal end and a separate closed inner container, or cylinder, wherein an outer diameter of said closed inner cylinder is substantially smaller than an inner diameter of said closed outer cylinder, thus defining an annulus between said closed outer cylinder and said closed inner cylinder. Said inner container is fixed to an inner surface of the distal end of said closed outer cylinder, such that the closed inner cylinder is concentric with the closed outer cylinder and does not otherwise contact the closed outer cylinder, and a proximal end of the closed inner cylinder is separated by space from the proximal end of the closed outer cylinder.

In the context of this discussion herein, the distal end is said to be "forward" of the proximal end and a direction from the proximal end toward the distal end will be referred to as "forward" in nature.

The proximal end of the closed inner cylinder is substantially smaller in cross sectional area than at a relatively more distal point at which the closed inner cylinder is fixed to the distal end of the closed outer cylinder in order to facilitate the passage of solid particles into the annulus defined between the outer cylinder and the inner cylinder. The inner cylinder is unrestrained and free to vibrate within the outer cylinder excepting the points of fixation with the inner surface of the distal end of the closed outer cylinder. A plurality of coaxial openings on the ends of the closed cylinders provide a means for a bullet, or any other similar type of projectile, to travel through the inner spaces formed by both the outer cylinder and the inner cylinder and thus exit the distal end of the device. The coaxial opening on the proximal end of the closed outer cylinder is further fashioned to receive a firearm muzzle or any other similar device attached to an end of a firearm muzzle.

Additionally, in a preferred embodiment, by way of illustration, but not limitation, the method of the present invention occurs in at least two separate stages; a primary stage and a secondary stage. The primary stage generally occurs within the components of the device that are physically defined by the volume and physical features of and exposed within the interior of the outer cylinder. The secondary stage generally occurs within the components of the device that are physically defined by the volume and physical features of and within the interior of the inner cylinder. Within said primary and secondary stages, explosive force containment, gas management, and separation of solids and coalescing metal vapors and liquids and entrapment thereof are treated as separate but concomitant events.

Hereinafter, burning and unburned solid propellant, other solids and coalescing metal vapors, and liquids are collectively referred to as "solids." Further, solids suspended in fluids are hereinafter referred to as "suspended" solids, and solids separated from suspension and at least temporarily deposited or removed from fluid flow are hereinafter referred to as "deposited" solids. Gases, non-coalescing vapors and gaseous fluids, Newtonian or non-Newtonian in behavior, are hereinafter collectively referred to as "gases." Used without modifiers, the term "propellant" is considered to be in either a solid state, a fluid state, or both. Additionally, as further discussed herein, the term "uncork" and its linguistic variants refers to a bullet's complete emergence from a firearm barrel at the muzzle.

In the primary stage, the bullet uncorks from the muzzle allowing exploding gases and solids to enter the volume of the outer cylinder and to at least partially envelope the bullet. A significant quantity of solids move substantially forward, surpassing the bullet and bypassing the bullet path hole at the proximal end of the inner cylinder to become deposited within the annulus defined by the inner and outer cylinder. Solids moving forward following the bullet pathway through the volume of the outer cylinder can enter the inner cylinder through that bullet path hole. As the bullet enters the bullet path hole at the proximal opening of the inner cylinder, a majority of the exploding gases surrounding the bullet are removed symmetrically about a longitudinal axis of the bullet as to avoid an imbalance of pressure forces caused by the exploding gases that remain with the bullet. In this primary stage, propellant continues to explode resulting in increasing gas pressure within the volume of the outer cylinder. As this gas pressure increases, the pressure differential between that volume and the volume within the inner cylinder tends to force the gases and suspended solids through the bullet path hole at the proximal end of the inner cylinder and into the volume of the inner cylinder, wherein a secondary stage of suppression occurs. The rate at which the gases transfer through that bullet path hole is generally regulated by the cross-sectional area of that hole. As a result, a substantially smaller hole would result in a substantially slower transfer rate allowing more time for propellant to burn within the primary stage, and thus, less solids to be transferred to the secondary stage.

As the bullet passes through the bullet path hole at the proximal opening of the inner cylinder, said bullet enters the volume of the inner cylinder within which the secondary stage of suppression occurs. Some solids that are not bypassing the bullet path hole in the primary stage will enter the volume of the inner cylinder. Additionally, gases and suspended solids will enter the inner cylinder, as discussed previously. Gases that are adjacent to and moving forward with the bullet are hereinafter referred to as "boundary layer" gases.

As the bullet moves forward through the volume of the inner cylinder, boundary layer gases explode and expand away from the bullet to disperse within the volume of the inner cylinder. As the bullet moves through the bullet path hole at the distal end of the device, much of the remaining boundary layer gases surrounding the bullet are removed symmetrically about the longitudinal axis of the bullet and are retained within the volume of the inner cylinder until ejected.

As gases and solids enter the volume of the inner cylinder, pressure increases at the proximal end of the cylinder, thereby forcing the contents of the inner cylinder towards the lower pressure of the distal end of the inner cylinder. As gases continue to expand and propellant continues to burn within the inner cylinder, pressure increases within the inner cylinder, thus resulting in a pressure differential between the volume of the inner cylinder and an outer location of the bullet pathway hole at the distal end of the device. The rate at which the gases transfer through the bullet path hole is regulated by the cross-sectional area of said bullet path hole. A substantially smaller hole would result in a substantially slower transfer rate allowing more time for propellant to burn within the secondary stage and thus less solids to be allowed to exit the device. This in turn reduces the rate at which gases and solids proceed through the primary stage and into the secondary stage, thereby allowing more time for propellant to burn within the primary stage.

Additionally, by way of illustration, but not limitation, within the volume of the outer cylinder or within the volume of the inner cylinder, an additional apparatus can be employed to cause improved boundary layer gases removal to preserve bullet stability, or solids deposition and propellant combustion efficiency, which in turn can either further reduce the release of unburned propellant, thereby allowing said unburned propellant to continue to burn or explode or be discharged from the device, or to increase turbulence of the fluid flow, thereby slowing the rate of gas discharge through the device and thus reducing the severity of the explosive release of gases and solids from the device.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

FIG. 4*a* depicts a longitudinal sectional view of an alternate embodiment of an inner cylinder baffle assembly of a sound suppression assembly of the present invention comprising a monolithic threaded baffle assembly inserted within a monolithic cap.

FIG. 4*b* depicts a longitudinal sectional view of an alternate embodiment of an inner cylinder baffle assembly of a sound suppression assembly of the present invention comprising a monolithic threaded baffle assembly in a removed configuration from a monolithic cap.

FIG. 5*a* depicts a longitudinal sectional view of an alternate embodiment of an inner cylinder baffle assembly of a sound suppression assembly of the present invention comprising a threaded baffle retainer cap and a plurality of individually stacked baffle members received within a monolithic cap.

FIG. 5*b* depicts a longitudinal sectional view of an alternate embodiment of an inner cylinder baffle assembly of a sound suppression assembly of the present invention comprising a threaded baffle retainer cap and a plurality of individually stacked baffle members in a removed configuration from a monolithic cap.

FIG. 5*c* depicts a longitudinal sectional view of an additional alternate embodiment of an inner cylinder baffle assembly of a sound suppression assembly of the present invention in a separated configuration from a threaded baffle retainer cap.

Figure 6:
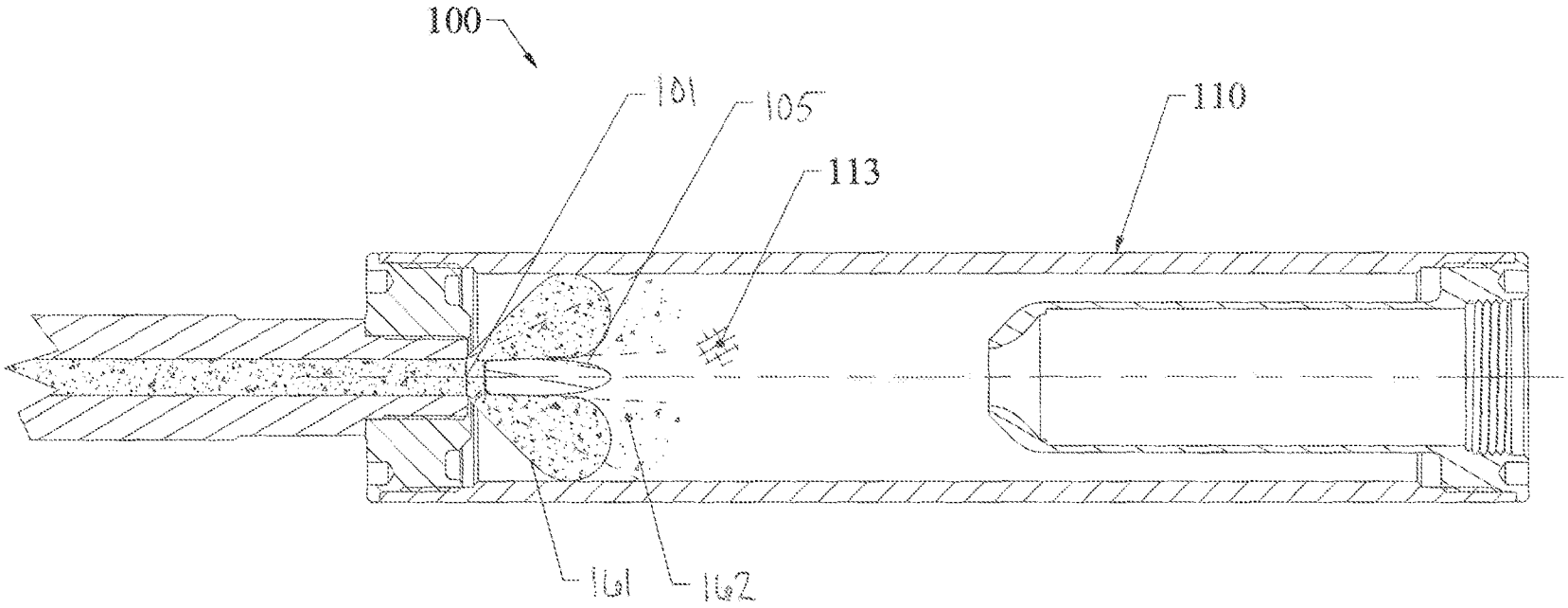

FIG. 6 depicts a longitudinal sectional view of a preferred embodiment of a firearm sound suppressor assembly of the present invention illustrating a differentiation in a solid/projectile flow of a plurality of propellant particles from a fluid/wave flow of a plurality of gases.

Figure 7:
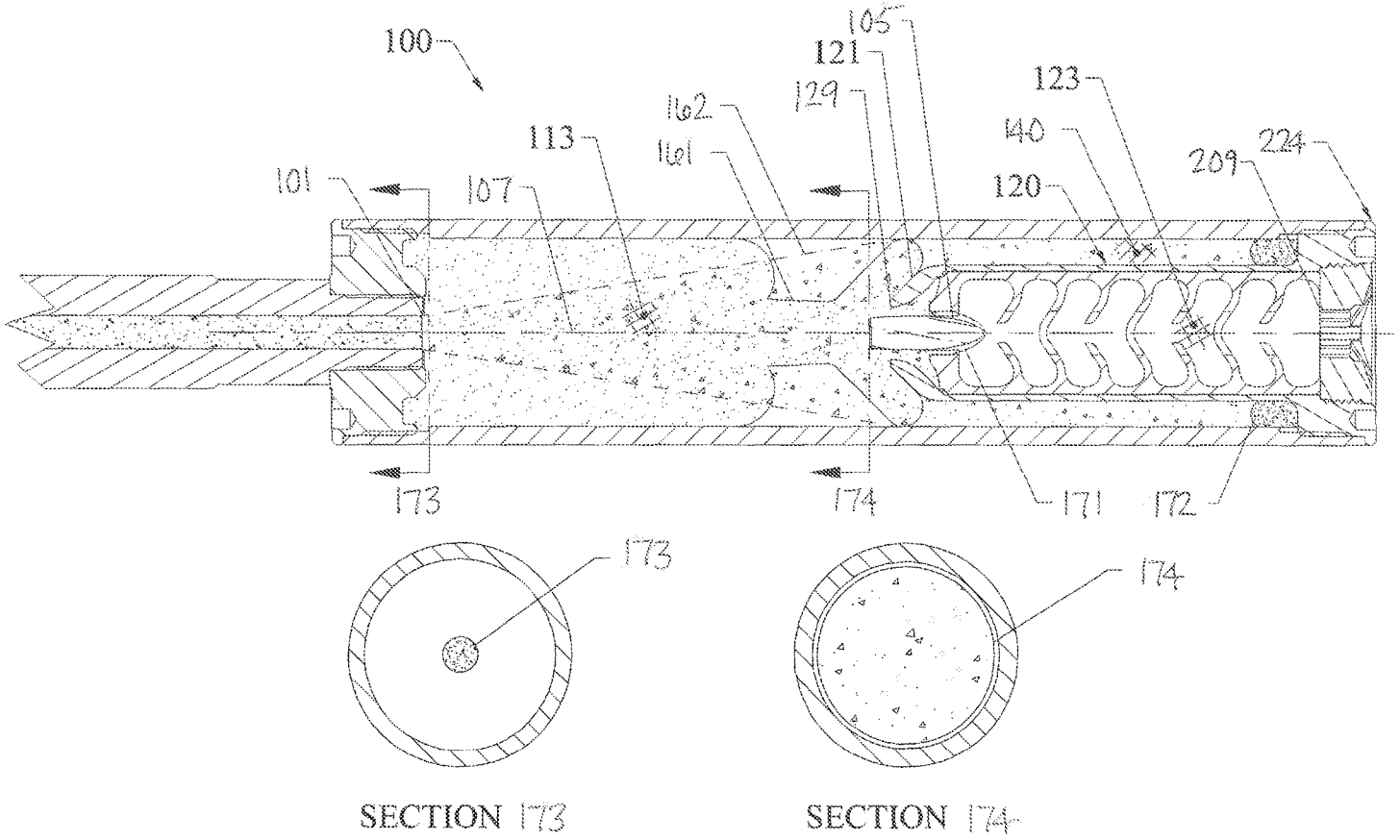

FIG. 7 depicts a longitudinal sectional view and a plurality of cross sectional views of a preferred embodiment of a firearm sound suppressor assembly of the present invention illustrating a primary stage of the present invention.

Figure 8A:
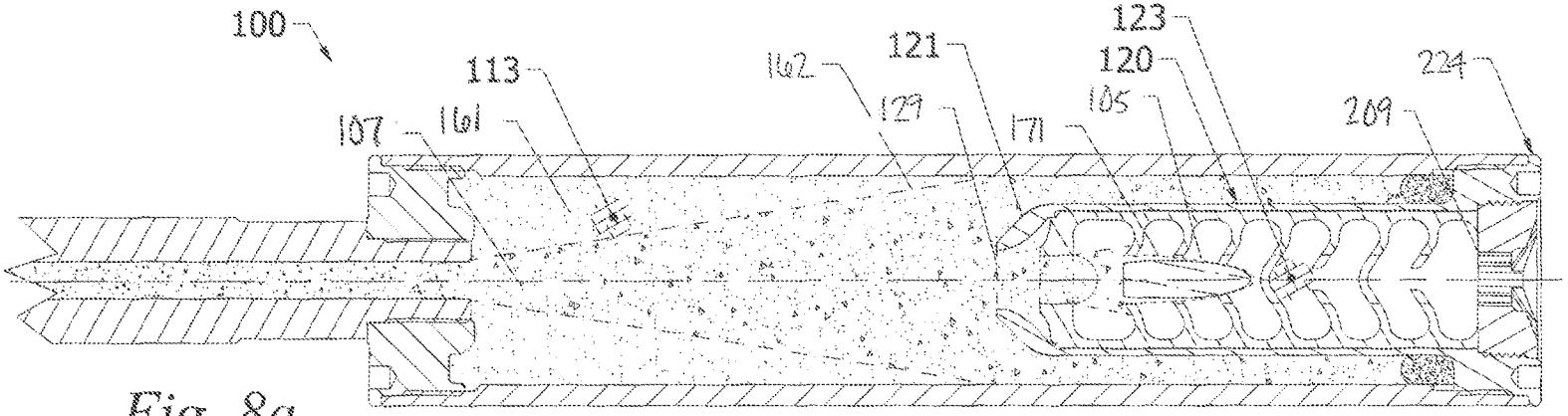

FIG. 8*a* depicts a longitudinal sectional view of a preferred embodiment of a firearm sound suppressor assembly of the present invention illustrating a transition from a primary to a secondary stage of the present invention.

Figure 8B:
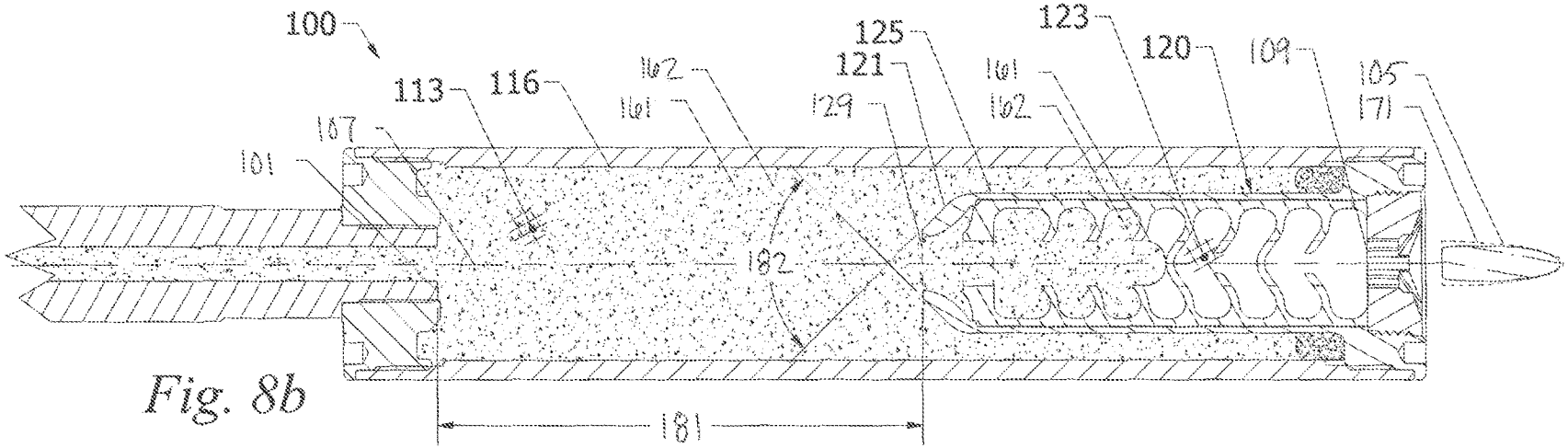

FIG. 8*b* depicts a longitudinal sectional view of a preferred embodiment of a firearm sound suppressor assembly of the present invention illustrating a completion of a secondary stage of the present invention.

DETAILED DESCRIPTION OF A PREFERRED EMBODIMENT

Referring to the drawings, a firearm sound suppressor assembly 100 of the present invention provides a means to maximize firearm suppressor efficiency with regards to maximizing sound attenuation, while preserving or improving bullet stability, improving positional stability of a firearm at a muzzle, managing recoil to preserve target acquisition and aim, minimizing physical size and weight, minimizing firearm backpressure and minimizing device complexity and manufacturing costs.

In a preferred embodiment, sound suppressor assembly 100 of the present invention can be manufactured from a variety of substantially high strength metals, such as, for example, titanium and Inconel, substantially high tensile strength aluminum alloys and stainless steel, or even composite materials and plastics, or any other similar material having like characteristics. Further, the present invention can be manufactured in a variety of different sizes, wherein the overall size of the sound suppressor assembly 100 and the relative sizes of the separate containers are dependent upon a user's specific application, firearm device, and desired physical and sound characteristics.

In general, by way of illustration, but not limitation, a substantially larger "primary" volume will result in reduced pressure while a substantially larger and longer inner cylinder may be desired to eliminate ejection of a slow-burning propellant. Also, a substantially longer distance between a firearm muzzle disposed at a proximal end of the device and a proximal end of an inner container can reduce a quantity of solids that are introduced directly from said firearm muzzle into said inner container. Moreover, although firearm sound suppressor assembly 100 can be manufactured as a monolithic unit using additive manufacturing methods, or as a welded, sealed, or otherwise unified assembly, a preferred embodiment uses selectively attached components to allow assembly of a variety of components to address a specific need, to customize for a variety of changing needs, to disassemble for cleaning or inspection and repair, or to replace damaged components, etc.

Figure 1:
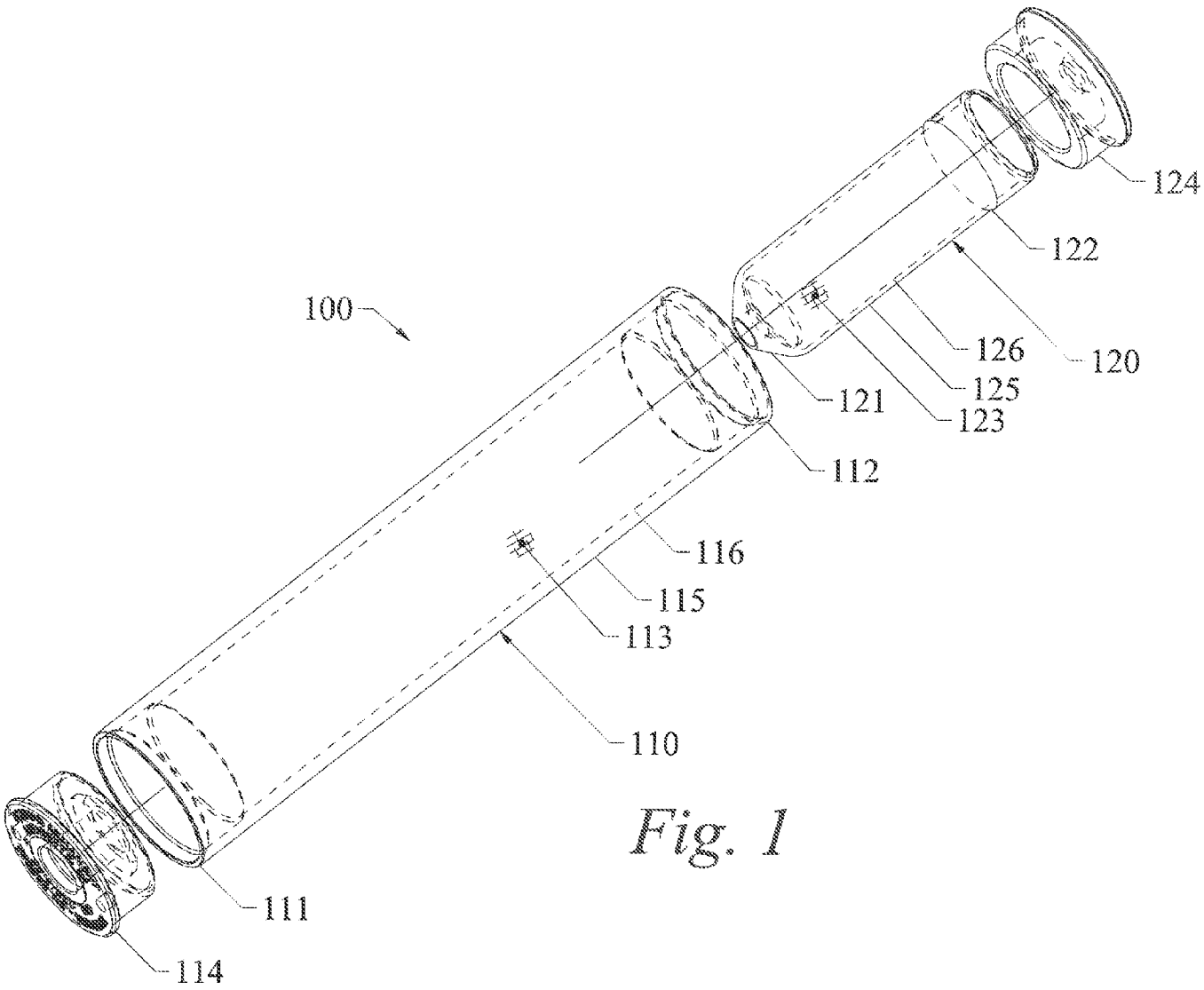
FIG. 1 depicts an exploded perspective view of a preferred embodiment of a sound suppressor assembly of the present invention.

FIG. 1 depicts an exploded perspective view of firearm sound suppressor assembly 100, generally comprising an outer cylinder 110 and an inner cylinder 120. Outer cylinder 110 comprises an outer diameter 115 and an inner diameter 116, thereby defining an inner chamber 113 for receiving inner cylinder 120. Additionally, outer cylinder 110 comprises a proximal end 111 and a distal end 112, wherein proximal end 111 is attachably connected to and closed by a base 114. Inner cylinder 120 comprises an outer diameter 125 and an inner diameter 126, thus defining an inner chamber 123. Further, inner cylinder 120 comprises a proximal end 121 and a distal end 122, wherein distal end 122 is attachably connected to and closed by a cap 124.

In a preferred embodiment, inner cylinder 120 can be received within outer cylinder 110, wherein said outer diameter 125 of inner cylinder 120 is substantially less than an inner diameter 116 of the outer cylinder 110, thereby forming an annulus 140 between outer cylinder 110 and inner cylinder 120. Also, an overall length of inner cylinder 120 is substantially less than a length of the distance between base 114 and cap 124. The distal end 122 of inner cylinder 120 is fixed to cap 124, and the proximal end 121 of inner cylinder 120 is otherwise unrestrained and separated by clear space from base 114 and from inner surface 116 of outer cylinder 110. As a result, there is no interruption or protrusion between proximal end 121 and outer diameter 125, thus allowing inner cylinder 120 to remain substantially free in order to vibrate unobstructed by outer cylinder 110 and base 114. Additionally, although not depicted in FIG. 1, the volume defined by an annulus 140 has substantially uninterrupted communication with the volume of inner chamber 113 between inner cylinder 120 and base 114 of outer cylinder 110.

Figure 2:
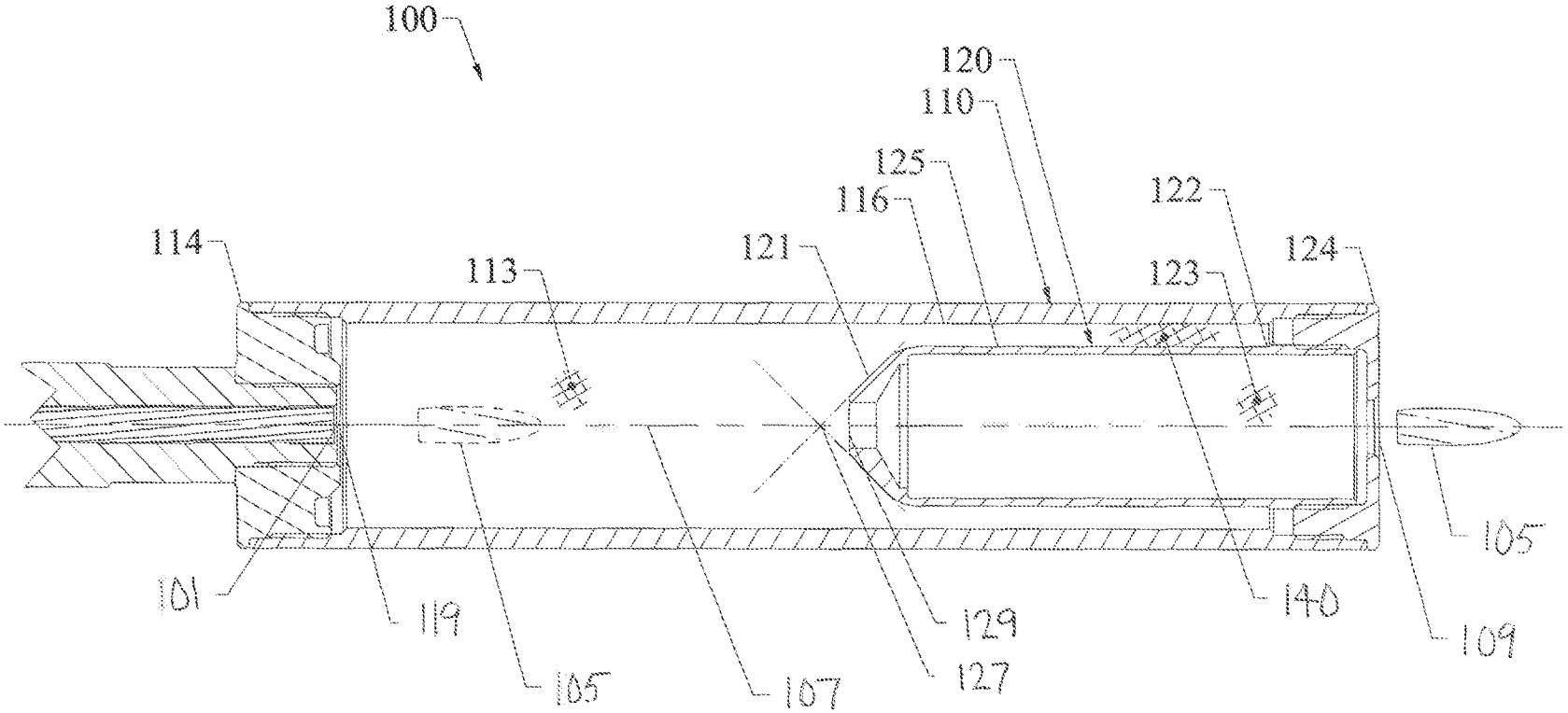
FIG. 2 depicts a longitudinal sectional view of a preferred embodiment of a sound suppressor assembly of the present invention in use with a firearm.

FIG. 2 depicts a longitudinal sectional view of firearm sound suppressor assembly 100 in use, wherein base 114 is used to attachably connect to a firearm muzzle 101 by way of a threaded connection. By way of illustration, but not limitation, base 114 can be used to attachably connect to a firearm muzzle 101, or any other similar device that can be attached to an end of a firearm muzzle 101, by way of a threaded connection or any other similar attachment means, such as, for example, a separate device allowing for rapid installation and removal of the firearm sound suppressor assembly of the present invention. Moreover, base 114 can also be formed as an integral component of a firearm barrel.

As depicted in FIG. 2, inner cylinder 120 is received within outer cylinder 110. An outer surface of proximal end 121 of inner cylinder 120 defines a substantially convex or projective conical shape with an apex 127 of the cone coincident with a bullet pathway 107 and the theoretical base of the cone, although not depicted in FIG. 2, distal to apex 127 of the cone, wherein the outer diameter of proximal end 121 of inner cylinder 120 is substantially smaller than the outer diameter of distal end 122 of inner cylinder 120, thereby comprising a substantially narrowed or tapered configuration. By way of illustration, but not limitation, it is to be observed that if an exterior of inner container 120 defines a polygonal cross-section rather than a circular cross-section, the analogous references to the conical shape of proximal end 121 would be that of a polyhedron.

In a preferred embodiment, outer surface 125 of inner container 120 and inner surface 116 of outer container 110 defines annular volume 140 within suppressor assembly 100 of the present invention. Base 114 comprises a coaxial opening 119, cap 124 comprises a coaxial opening 109, and proximal end 121 of inner cylinder 120 comprises a coaxial opening 129, wherein coaxial openings 119, 129, and 109 of base 114, proximal end 121, and cap 124, respectively, are in fluid communication, and thus, define a bullet pathway 107, thereby providing a means for bullet 105, or other projectile, to travel through inner chambers 113 and 123 defined by both outer container 110 and inner container 120, respectively, and to exit said firearm sound suppressor assembly 100 at cap 124.

Figure 3:
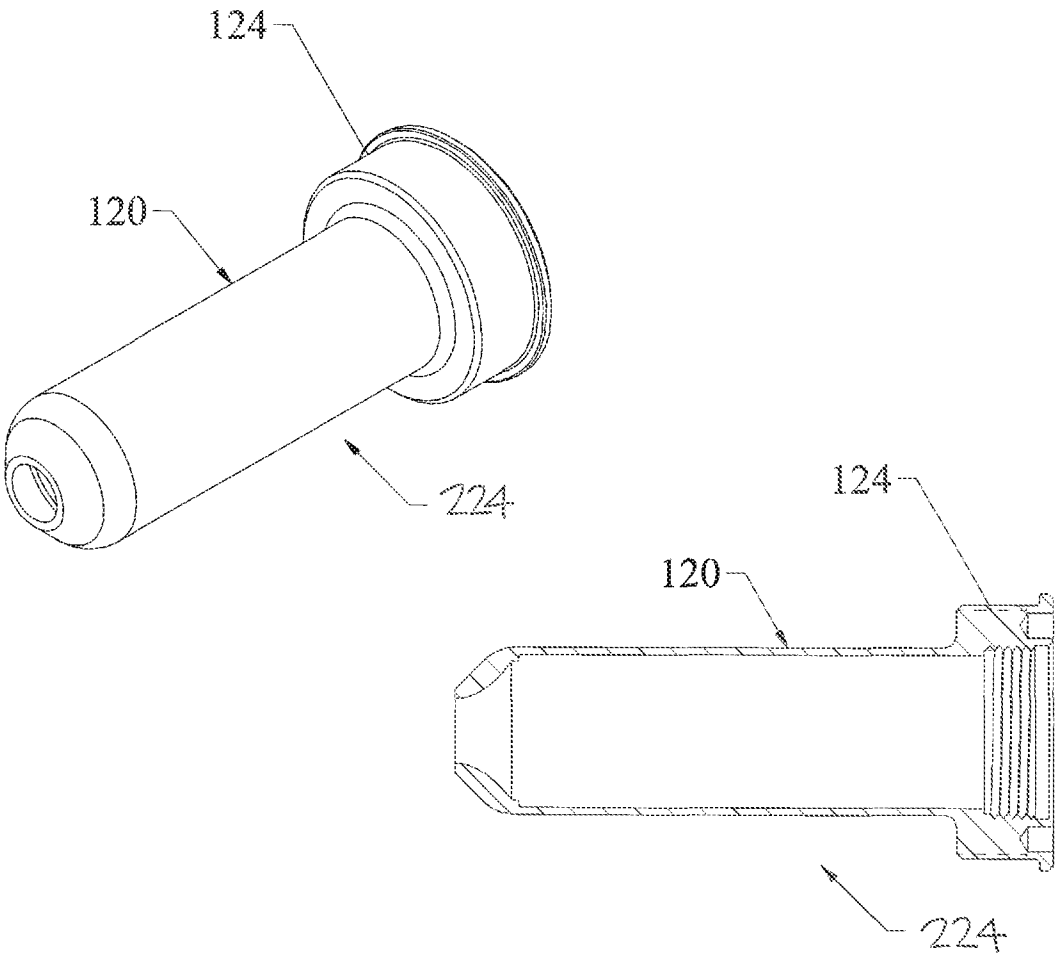
FIG. 3 depicts a perspective and a longitudinal sectional view of an alternate embodiment of a monolithic cap of an outer cylinder of a sound suppressor assembly of the present invention.

FIG. 3 depicts a perspective view and a longitudinal sectional view of an alternate embodiment of inner cylinder 120 and cap 124 of the present invention. As illustrated in FIG. 3, in an alternative embodiment, inner cylinder 120 and cap 124 can be combined and manufactured into a single unified structure, or a monolithic cap 224 of outer cylinder 110. It is to be observed that monolithic cap 224 retains the same features of inner cylinder 120 and cap 124 and also provides a means to threadably receive a variety of other devices, such as, for example, a monolithic baffle.

FIG. 4*a* depicts a longitudinal sectional view of an alternate embodiment of sound suppressor assembly 100 comprising a monolithic baffle assembly 130 received within monolithic cap 224. FIG. 4*b* depicts a longitudinal sectional view of an alternate embodiment of sound suppressor assembly 100 comprising monolithic baffle assembly 130 in a removed configuration from monolithic cap 224.

Monolithic baffle assembly 130 comprises a substantially cylindrical body member 134, having an outer diameter 135, a proximal end 131, a distal end 132, a cap 133, a proximal coaxial opening 139 and a distal coaxial opening 137. Outer diameter 135 of monolithic baffle assembly 130 is substantially less than inner diameter 126 of inner cylinder 120. The proximal coaxial opening 139 and distal coaxial opening 137 axially align with bullet pathway 107 defined by suppressor assembly 100, thereby forming a substantially central channel to allow bullet 105 to exit sound suppressor assembly 100. Additionally, body member 134 of monolithic baffle 130 can be fashioned to create a plurality of openings, or expansion chambers, in order to produce a specific effect, such as, for example, improved propellant combustion efficiency. Cap 133 provides a means for monolithic baffle 130 to threadably attach to monolithic cap 224.

As depicted in FIGS. 4*a* and 4*b*, in an alternate embodiment, monolithic baffle assembly 130 can be received within monolithic cap 224, or inner cylinder 120 and cap 124, of sound suppression assembly. Thus, baffle assembly 130 can be employed to cause improved propellant combustion efficiency, which in turn can further reduce the release of unburned propellant 162 and increase turbulence of the fluid flow, thereby slowing the rate of gas discharge through the device 100 and thus reducing the severity of the explosive release of gases 161 and solids 162 from sound suppression assembly 100. As a result, in an alternate embodiment, baffle assembly 130 may be employed to further remove boundary layer gases 171 from bullet 105, further slow the release of gases 161 and propellants 162, and thus further trap solids 162 within interior 134 of baffle assembly 130, as further discussed herein.

FIG. 5*a* depicts a longitudinal sectional view of an alternate embodiment of a baffle assembly 230 received within monolithic core 224, wherein baffle assembly 230 comprises a plurality of stacked baffles 234, or a series of individually created baffle members which are stacked together to create a core, or body member. FIG. 5*b* depicts a longitudinal sectional view of an alternate embodiment of stacked baffle assembly 230, wherein stacked baffle assembly 230 is removed from monolithic core 224. Thus, as illustrated in FIG. 5*b*, baffle assembly 230 comprises a plurality of discrete baffles 234 retained within monolithic cap 224 by cap 233.

As illustrated in FIGS. 5*a* and 5*b*, baffle assembly 230 comprises stacked baffle members 234, having an outer diameter 235, a proximal end 231, a distal end 232, a cap 233, a proximal coaxial opening 239 and a distal coaxial opening 237. Outer diameter 235 of baffle assembly 230 is substantially less than inner diameter 126 of inner cylinder 120. The proximal coaxial opening 239 and distal coaxial opening 237 axially align with bullet pathway 107 defined by suppressor assembly 100, thereby forming a substantially central channel to allow bullet 105 to exit sound suppressor assembly 100. Additionally, stacked baffle members 234 of baffle assembly 230 can be fashioned to create a plurality of openings, or expansion chambers, in order to produce a specific effect, such as, for example, improved propellant combustion efficiency. Cap 233 provides a means for baffle assembly 230 to threadably attach to monolithic cap 224.

FIG. 5*c* depicts a longitudinal sectional view of an additional alternate embodiment of a monolithic baffle assembly 330, wherein monolithic baffle assembly 330 comprises a body member 334 in a detachable and separated configuration from a threadably attached baffle retainer cap 333. In an alternate embodiment, threadably removable baffle cap 333 may be ideal in a variety of different applications, depending on a user's particular needs.

FIG. 6 depicts a longitudinal sectional view of firearm sound suppressor assembly 100 in operation, illustrating a method of sound suppression of the present invention involving at least two stages, a primary stage and a secondary stage. Although FIG. 6 depicts firearm sound suppressor assembly 100 comprising monolithic cap 224, it is to be noted that firearm sound suppressor assembly 100 can also be used in operation comprising inner cylinder 120 and cap 124. In the primary stage of the method, as bullet 105 uncorks and releases from firearm muzzle 101, a plurality of gases 161 and solids 162 primarily generated by exploding propellant within a firearm barrel begin to move forward simultaneously with bullet 105 and enter inner chamber 113, and thus volume, of outer cylinder 110. Under extreme pressure, as depicted in FIG. 6, the dense gases 161 accelerate and expand as they exit firearm muzzle 101 as they are no longer restricted by a relatively slow moving bullet 105, or other projectile. Substantially heavier solids 162 will typically move independently with respect to gases 161 and will therefore move in a relatively straight and substantially forward direction within sound suppressor assembly 100. To an extent depending largely on the geometry of a portion of bullet 105 to which the expanding gases 161 are exerting pressure and the velocity of bullet 105, gases 161 will at least partially envelop bullet 105 before the forward velocity of bullet 105 eventually exceeds that of the envelope of the expanding gases 161.

FIG. 7 depicts a longitudinal sectional view and a plurality of cross sectional views of firearm sound suppressor assembly 100 in operation, illustrating a method of sound suppression of the present invention involving at least two stages, a primary stage and a secondary stage. Although FIG. 7 depicts monolithic cap 224 received within outer cylinder 110, it is to be observed that inner cylinder 120 and cap 124 can also be used in operation. Additionally, by way of illustration, but not limitation, monolithic baffle assembly 130 can be received within monolithic cap 224, or inner cylinder 120 and cap 124, as desired.

In the primary stage of the method, as depicted in FIG. 7, bullet 105 advances forward along bullet pathway 107 and into coaxial opening 129 at proximal end 121 of inner cylinder 120, wherein gases 161 and solids 162 surrounding bullet 105 within inner chamber 113 of outer cylinder 110 are prevented from following bullet 105 into inner chamber 123 of inner cylinder 120, to the extent that gases 161 and solids 162 follow bullet 105 at a coaxial radial distance from the bullet pathway 107 substantially greater than that of opening 129 at proximal end 121 of inner cylinder 120. As such, the diameter of coaxial opening 129 has a direct relationship to the amount of gases 161 and solids 162 that can enter inner cylinder 120 simultaneously with bullet 105 as bullet 105 enters inner chamber 123 of inner cylinder 120. A substantially small amount of gases that remain with and adjacent to bullet 105 as bullet 105 enters inner chamber 123 of inner cylinder 120 are hereinafter referred to as remaining boundary layer gases 171.

Simultaneously, as bullet 105 advances forward along bullet pathway 107 and into coaxial opening 129 at proximal end 121 of inner cylinder 120, solids 162 ejected from muzzle 101 follow and may overtake the advancing bullet 105. As illustrated in FIG. 7, a cross-sectional sample 173 of the stream of solids 162 at muzzle 101 will have the same cross-sectional area of the muzzle 101. As this sample of solids 162 approaches coaxial opening 129 at proximal end 121 of inner cylinder 120, its cross-sectional area 174 increases and, assuming no other solids are introduced, the number of solids 162 per unit area within cross-section 174 decreases with respect to the number of solids 162 per unit area within cross-section 173 because the number of solids in that sample remains the same, but now occupies a substantially larger cross-sectional area.

As the sample of solids 162 reaches and moves forward of coaxial opening 129 at proximal end 121 of inner cylinder 120, solids 162 that follow bullet 105 and occupy the area defined by coaxial opening 129 will enter inner cylinder 120. However, a substantial quantity of solids 162 remain outside of that area and continue to move substantially forward of and distal to proximal end 121 of inner cylinder and within annulus 140. Additionally, a substantial quantity of solids 162 entering annulus 140 will remain deposited within annulus 140. These deposited solids 172 will tend to not return to inner chamber 113 at a proximal location to coaxial opening 129 at proximal end 121 of inner cylinder 120, and thus deposited solids 172 will generally remain positioned within annulus 140 towards distal end 122. Moreover, solids without adequate momentum to move independently with respect to gases 161 become suspended within gases 161 and are subject to move with the fluid flow of the gases 161. These solids are hereinafter referred to as suspended solids.

FIG. 8*a* depicts a longitudinal sectional view of firearm sound suppressor assembly 100 illustrating a transition from a primary to a secondary stage of the method of the present invention. FIG. 8*b* depicts a longitudinal sectional view of firearm sound suppressor assembly 100 illustrating the method of a secondary stage of the present invention. By way of illustration, but not limitation, FIGS. 8*a* and 8*b* depict firearm sound suppressor assembly 100 comprising monolithic cap 224 and monolithic baffle 130; however, it is to be observed that inner cylinder 120 and cap 124 can also be utilized and monolithic baffle 130 can be removed, as desired. In a preferred embodiment, a method of sound suppression of the present invention involves at least two stages, a primary stage and a secondary stage, wherein bullet 105 advances forward along bullet pathway 107 and into coaxial opening 129 past proximal end 121 of inner cylinder 120, wherein gases 601 and solids 602 are substantially removed from close proximity of bullet 105.

As depicted in FIG. 8*a*, to the extent that gases 161 behave as a Newtonian fluid, gases 161 and solids 162 within the firearm barrel continue to empty into inner chamber 113 of the device as the difference in pressures inside the barrel and inner chamber 113 approaches equilibrium. Burning propellant within solids 162 release additional gases within inner chamber 113, which in turn cause a substantial increase in pressure within inner chamber 113. The pressure differential between inner chamber 113 and inner chamber 123 distal to coaxial opening 129 at proximal end 121 of inner cylinder 120 will cause gases 161 and suspended solids 162 to move from inner chamber 113 to inner chamber 123 through coaxial opening 129.

Bullet 105, which is now completely within inner chamber 123, is substantially removed from the enveloping gases 161 and solids 162 and the forces associated with gases 161 and solids 162. Remaining boundary layer gases 171 will remain near bullet 205 until shed naturally within inner chamber 123 or outside of firearm sound suppressor assembly 100. A variety of different features, similar to those depicted with monolithic baffle 130, may be used to facilitate removal of remaining boundary layer gases 171 within inner chamber 123.

As depicted in FIG. 8*b*, to the extent that gases 161 behave as a Newtonian fluid, gases 161 and suspended solids 162 within inner chamber 113 continue to move from inner chamber 113 to inner chamber 123 through coaxial opening 129, as the substantial difference in pressures inside inner chamber 113 and inner chamber 123 approaches equilibrium. Pressure substantially increases within inner chamber 123 with the introduction of gases 161 and solids 162 and with the generation of additional gases due to burning and exploding gases 161 and solids 162. As pressure increases within inner chamber 123, gases 161 and suspended solids 162 move forward, thereby filling inner chamber 123. Gases 161 and suspended solids 162 within inner chamber 123 continue to move from inner chamber 123 to an outside location of sound suppressor assembly 100 at coaxial opening 209, as the difference in pressures inside inner chamber 123 and outside of sound suppressor assembly 100 at coaxial opening 209 approaches equilibrium.

A variety of different features, similar to those depicted with monolithic baffle 130, may be used to facilitate removal of remaining boundary layer gases 171 within inner chamber 123 and thus retard the propagation of gases 161 and suspended solids 162 forward through inner chamber 123.

The efficiency of the method of the present invention, and likewise, the efficacy of the separation of solids from gases and the entrapment process is affected by a distance 181 between muzzle 101 and coaxial opening 129 at proximal end 121 of inner cylinder 120, an angle 182 of the aperture 127 of the cone defined by proximal end 121 of inner cylinder 120, the cross-sectional area of coaxial opening 129 at proximal end 121 of inner cylinder 120, inside diameter 116 of outer cylinder 110, and outside diameter 125 of inner cylinder 120. An optimal condition for these factors typically depends on a variety of different outside factors, such as bullet weight and geometry, propellant characteristics, barrel length, etc. The firearm sound suppressor assembly 100 of the present invention can be selectively assembled with components of various or adjustable size and geometry consistent with that described in these specifications to optimize the performance of the device for a specific application.

Referring to FIGS. 8*a* and 8*b*, within volume 150, an additional apparatus, such as, for example, baffle assembly 130, can be employed to cause improved propellant combustion efficiency which in turn can further reduce the release of unburned propellant 162, thereby allowing unburned propellant 162 to continue to burn or to increase turbulence of the fluid flow, thereby slowing the rate of gas discharge through the device 100 and thus reducing the severity of the explosive release of gases 161 and solids 162 from sound suppression assembly 100. Thus, in an alternate embodiment, and as depicted in FIGS. 8*a* and 8*b*, within volume 150, baffle assembly 130 may be employed to further remove remaining boundary layer gases 171 from bullet 105, further slow the release of gases 161 and propellants 162, and thus further trap solids 162 within interior 134 of baffle assembly 130.

Furthermore, as illustrated in FIGS. 2, 6, 7 and 8, the arrangement of the physical features of sound suppressor assembly 100 act as a vibration absorber in order to move a harmonic node of a vibrating barrel in a substantially closer direction to muzzle 101. The inner cylinder 120, fixed at the distal end to cap 124, is otherwise allowed to vibrate free from interference from outer cylinder 110, firearm muzzle 101 or any other physical feature of the device. The masses and physical dimensions of the individual components described herein each affect the harmonic vibration characteristics of the firearm when attached to the present invention 100. An optimal combination of these factors depends on a variety of different outside factors, such as bullet weight and geometry, gunpowder burn characteristics, barrel length, barrel mass, firearm accessories and attachments, etc.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for firearm sound suppression comprising:
   a) an outer container having a proximal end, a distal end, an outer surface, and an inner surface defining an inner chamber, wherein said proximal end and said distal end each comprise an opening defining a bullet pathway and said proximal end of said outer container attachably connects to a firearm muzzle;
   b) an inner container having a proximal end, a distal end, an outer surface, and an inner surface defining an inner chamber, wherein:
      i) said proximal end and said distal end each comprise an opening defining a bullet pathway,
      ii) said inner container comprises a substantially smaller cross section and length than said outer container,
      iii) said inner container is disposed within said inner volume of said outer container, and
      iv) said inner container is attachably connected to said inner surface of said distal end of said outer container, and said inner container is otherwise unrestrained within said outer container; and
   c) an annulus that is formed between said outer surface of said inner container and said inner surface of said outer container, wherein said annulus has no other communication with said inner chamber of said inner container other than through said proximal end opening defining said bullet pathway.

2. An apparatus for firearm sound suppression comprising:
   a) an outer container having a proximal end, a distal end, an outer surface, and an inner surface defining an inner chamber, wherein said proximal end and said distal end each comprise an opening defining a bullet pathway and said proximal end of said outer container attachably connects to a firearm muzzle;
   b) an inner container having a proximal end, a distal end, an outer surface, and an inner surface defining an inner chamber, wherein:
      i) said proximal end and said distal end each comprise an opening defining a bullet pathway,
      ii) said inner container comprises a substantially smaller cross section and length than said outer container,
      iii) said inner container is disposed within said inner volume of said outer container, and
      iv) said inner container is attachably connected to said inner surface of said distal end of said outer container, and said inner container is otherwise unrestrained within said outer container;
   c) an annulus that is formed between said outer surface of said inner container and said inner surface of said outer container, wherein said annulus has no other communication with said inner chamber of said inner container other than through said proximal end opening defining said bullet pathway; and
   d) a cap member that attachably connects to said distal end of said inner container, wherein said cap member comprises an opening.

3. A method of suppressing sound from a firearm comprising:

a) a projectile uncorking from said firearm and entering into a firearm sound suppression apparatus, wherein said apparatus comprises;

i) an outer container having a proximal end, a distal end, an outer surface, and an inner surface defining an inner chamber, wherein said proximal end and said distal end each comprise an opening defining a bullet pathway and said proximal end of said outer container attachably connects to a firearm muzzle;

ii) an inner container having a substantially conical shaped proximal end, a distal end, an outer surface, and an inner surface defining an inner chamber, wherein:

1) said proximal end and said distal end each comprise an opening defining a bullet pathway, 2) said inner container comprises a substantially smaller cross section and length than said outer container, 3) said inner container is disposed within said inner volume of said outer container, 4) said inner container is attachably connected to said inner surface of said distal end of said outer container, and said inner container is otherwise unrestrained within said outer container;

iii) an annulus that is formed between said outer surface of said inner container and said inner surface of said outer container, wherein said annulus has no other communication with said inner chamber of said inner container other than through said proximal end opening defining said bullet pathway;

iv) a cap member that attachably connects to said distal end of said inner container, wherein said cap member comprises an opening;

b) said projectile and a plurality of gases and solids entering into said inner chamber of said outer container and moving in a direction toward said distal end, wherein said gases and said solids separate;

c) said conical configuration of said proximal end of said inner container preventing said gases located adjacent to said projectile from advancing through said proximal end opening of said inner chamber with said projectile, thereby isolating said projectile;

d) said projectile entering into said inner chamber of said inner container and moving in a direction toward said distal end;

e) said projectile exiting said apparatus through said opening of said cap member;

f) said gases moving in a direction toward said distal end of said outer container, moving through said opening and said inner chamber of said inner container, and exiting said opening of said cap member in a substantially gradual manner; and g) said solids depositing within said distal end of said inner chamber of said outer container and said annulus.

* * * * *